US005968435A

United States Patent [19]

Kato et al.

[11] Patent Number: 5,968,435

[45] Date of Patent: Oct. 19, 1999

[54] PROCESS FOR MANUFACTURING PITCH-TYPE CARBON FIBER

[75] Inventors: Osamu Kato, Tokyo; Yoshio Kishimoto, Yokohama; Yutaka Arai, Tokyo; Hajime Nakajima, Yokohama; Masatoshi Furuyama, Kawasaki; Tsutomu Kihara, Yokohama; Michiharu Harakawa, Yokohama; Shigeo Hara, Yokohama; Ken Kobayashi, Himeji; Yoshiyuki Doken, Himeji; Tsutomu Nakamura, Himeji, all of Japan

[73] Assignees: Nippon Steel Corporation; Nippon Steel Chemical Co., Ltd; Nippon Graphite Fiber Corporation, all of Tokyo, Japan

[21] Appl. No.: 09/065,276

[22] Filed: Apr. 23, 1998

[30] Foreign Application Priority Data

Apr. 24, 1997 [JP] Japan ..... 9-106875

[51] Int. Cl.[6] ..... D01D 4/00; D01F 9/12

[52] U.S. Cl. ..... 264/211.11

[58] Field of Search ..... 264/211.11

[56] References Cited

U.S. PATENT DOCUMENTS

| | | | |
|---|---|---|---|
| 4,818,612 | 4/1989 | Hara et al. . | |
| 4,923,648 | 5/1990 | Hara et al. . | |
| 5,169,584 | 12/1992 | Ross et al. | 264/211.11 |

FOREIGN PATENT DOCUMENTS

| | | |
|---|---|---|
| 349 307 | 1/1990 | European Pat. Off. . |
| 3-816 | 1/1991 | Japan . |

*Primary Examiner*—Leo B. Tentoni
*Attorney, Agent, or Firm*—Scully, Scott, Murphy & Presser

[57] ABSTRACT

In a step of spinning a molten mesophase pitch in a process for manufacturing a pitch-type carbon fiber, the pitch is allowed to pass through an orifice and to be contracted once, is then expanded in an introduction port with a diameter greater than that of the orifice, and is then allowed to pass through an outlet pore formed at a collecting portion to spin the pitch. The pitch-type carbon fiber has a high elastic modulus in tension and high compressive strength.

5 Claims, 4 Drawing Sheets

PROCESS FOR MANUFACTURING PITCH-TYPE CARBON FIBER

FIELD OF THE INVENTION

The present invention relates to a process for manufacturing a pitch-type carbon fiber, and, particularly, to a process for manufacturing a pitch-type carbon fiber having a high elastic modulus in tension and increased compressive strength.

Carbon fibers having high tensile strength, elastic modulus, and compressive strength which are produced in the present invention can be suitably used as reinforced fibers for composite materials used in a variety of industrial fields such as aerospace industries and sport and leisure industries as well as automobile and construction industries.

BACKGROUND OF THE INVENTION

Among pitch-type carbon fibers, carbon fibers using a mesophase pitch as a starting raw material have the advantage that products having an extremely high elastic modulus can be produced.

There have been even industrial products of pitch-type carbon fibers having an elastic modulus touching a level as high as 950 GPa which is almost equal to the theoretical elastic modulus of a graphite crystal in the direction of the axis A.

Pitch-type carbon fiber products with a tensile strength of a level of 3 to 4 GPa have also been commercially available. Also, pitch-type carbon fibers having the performance equal to that of polyacrylonitrile (PAN)-based carbon fibers representing the high strength carbon fibers have been available in recent years.

However, a composite material using the pitch-type carbon fiber has the problem that it has the compressive characteristics, especially, the compressive strength inferior to that of composite materials using the PAN-based carbon fibers. The practical properties, such as bending strength, of a composite material depend on the compressive strength of the carbon fiber. The pitch-type carbon fiber has a compressive strength lower than that of the PAN-based carbon fiber, which limits the application of the composite material using the pitch-type carbon fiber.

In order to solve this problem, Japanese Patent Application Laid-Open (JP-A) No. 2-14023 proposes a method in which a pitch containing 5 to 40% of an optically anisotropic phase and having a viscosity of 100 Pa.s that is conspicuously high for the spinning of the pitch is spun to produce a carbon fiber and thereby to improve the compressive strength. Also, Japanese Patent Application Laid-Open (JP-A) No. 3-816 discloses a method in which boron ions are injected into a pitch-type carbon fiber under vacuum to improve the compressive strength. These methods are extremely unique in operational conditions and require unpractical steps posing many drawbacks in the preparation of pitch-type carbon fibers industrially improved in the compressive strength.

Disclosed in Japanese Patent Application Laid-Open (JP-A) No.61-258024 is a method for producing a carbon fiber wherein a screen layer is attached to the end of an introduction port in the side of an outlet pore to pass a pitch through the screen layer and the outlet pore in this order thereby performing the spinning. However, industrial production using this method requires much labor and cost and also this method is yet insufficient to produce the compressive strength equal to that of the PAN-based carbon fiber.

In order to improve the compressive strength of a composite material while maintaining the rigidity of the carbon fiber, it is necessary to improve the compressive strength of the carbon fiber itself.

OBJECTS OF THE INVENTION

It has been clarified from the results of extensive studies by the present inventors that the compressive strength of the pitch-type carbon fiber is also dependent on the crystallite-sized microstructure of the carbon fiber and varies depending on the so-called macrostructure, e.g. a radial structure, random structure, onion structure, in the direction of the transversal cross section perpendicular to the axis of the carbon fiber.

The transversally sectional structure must be a special fiber structure to improve the compressive strength. The inside of the carbon fiber forms a union structure or a random structure and the surface layer of the carbon fiber forms a random structure without much proportion of a radial component. Such a structure in the direction of the transversal cross section of the carbon fiber is generally determined in the stage of melt spinning.

Accordingly, an object of the present invention is to provide a carbon fiber with a highly compressive strength. Preferably, the object of the present invention is to provide a process for industrially and simply manufacturing a pitch-type carbon fiber having highly compressive strength even in a range of high elastic modulus exceeding 500 GPa.

SUMMARY OF THE INVENTION

According to a first aspect of the present invention, there is provided a process for manufacturing a pitch-type carbon fiber by melt-spinning a mesophase pitch before infusible and calcinating treatments, the ratio of non-oriented carbon of the mesophase pitch being in range from 0.21 to 0.37 at 300° C. and in a range from 0.16 to 0.31 at 340° C., the process resides in:

a step of melting the mesophase pitch;

a step of contracting the molten pitch once at an inlet portion of a nozzle;

a step of expanding the pitch in an introduction port with a diameter greater than that of the inlet portion of the nozzle;

a step of contracting the pitch again at a first approach section in which the nozzle has a shape spreading at an angle of 40 to 150 degrees from an outlet pore to the introduction port and at a second approach section in which the nozzle has a shape spreading at an angle of 170 to 185 degrees to the introduction port positioned between the first approach section and the outlet pore; and a step of passing the pitch through the outlet pore disposed at an collecting portion of the second approach section to spin the pitch.

According to a second aspect of the present invention, there is provided a process for manufacturing a pitch-type carbon fiber by melt-spinning a mesophase pitch before infusible and calcinating treatments,, the process resides in:

a step of passing the pitch through a screen attached to an inlet portion of a template;

a step of passing the pitch through an orifice to contract the pitch once;

a step of expanding the pitch in an introduction port with a diameter greater than that of the orifice; and a step of passing the pitch through an outlet pore disposed at an collecting portion to spin the pitch.

BRIEF DESCRIPTION OF THE DRAWINGS

FIGS. 3 to 5 are views of a second embodiment of the present invention, in which FIG. 3 is a typical view showing an example of a nozzle.

FIG. 4 shows another example of a nozzle with one approach section.

FIG. 5 shows a further example of a nozzle provided only with a template.

Figure 1:
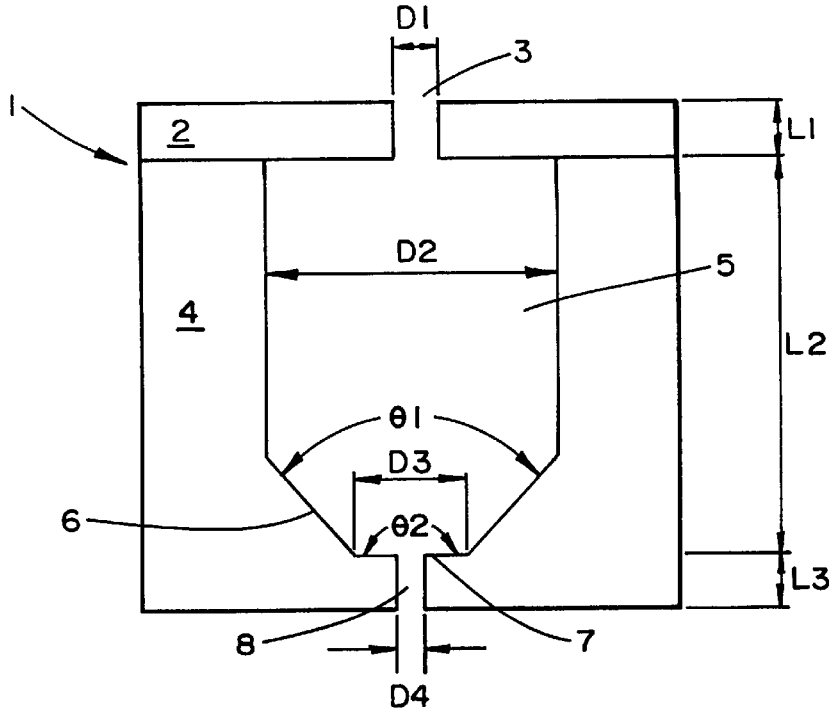
FIG. 1 is a typical view showing an example of a nozzle used in a first embodiment of the present invention.

The symbols in the figures are as follows: 1: Nozzle, 2: Template, 3: Inlet portion of a nozzle (orifice), 4: Spinning dice, 5: Introduction port, 6: First approach section, 7: Second approach section, 8: Outlet pore, 9: Screen.

DETAILED DESCRIPTION OF THE INVENTION

First, a first embodiment of the present invention will be explained.

A process of the first embodiment comprise a step of melting a mesophase pitch with the ratio of non-oriented carbon being in a range from 0.21 to 0.37 at 300° C. and in a range from 0.16 to 0.31 at 340° C.; a step of contracting the molten pitch once at an inlet portion of a nozzle; a step of expanding the pitch in an introduction port with a diameter greater than that of the inlet portion of the nozzle; a step of contracting the pitch again at a first approach section in which the nozzle has a shape spreading at an angle of 40 to 150 degrees from an outlet pore to the introduction port and at a second approach section in which the nozzle has a shape spreading at an angle of 170 to 185 degrees to the introduction port positioned between the first approach section and the outlet pore; and a step of passing the pitch through the outlet pore disposed at an collecting portion of the second approach section to spin the pitch.

A pitch used as the starting raw material is a mesophase pitch with the ratio of non-oriented carbon being in a range from 0.16 to 0.31 at 340° C.

The mesophase pitch used in the present invention which satisfies the above requirements can be produced according to the following exemplified process.

The mesophase pitch as the starting raw material of a carbon fiber include those produced by hydrotreating heavy bituminous materials and by subsequent first heat treatment and second heat treatment under reduced pressure.

The heavy bituminous material may be either a coal-type or a petroleum-type though heavier fractions, specifically pitches, in the heavy bituminous material are desirable.

Examples of these pitches include a coal-tar pitch and liquefied coal pitch as the coal-type and various pitches such as an ethylene tar pitch, decant oil pitch, and the like as the petroleum-type.

An anthracene oil may be added generally in an amount of 1 to 200 parts by weight to 100 parts by weight of the pitch.

Hydrogenated bituminous materials obtained by hydrotreating the heavy bituminous material using a hydrogen-donating solvent or hydrogen gas may be used. Also, materials prepared by removing solid materials from these hydrogenated bituminous materials in advance by means of filtration, sedimentation, centrifugation, or the like may be used.

A composition prepared by adding 10 to 200 parts by weight of a mixture of condensed polycyclic (dicyclic or more) aromatic compounds to 100 parts by weight of the heavy bituminous material is hydrotreated in the condition of a temperature of 300 to 450° C., a hydrogen pressure of 50 to 200 kg/cm$^2$, and a liquid space velocity (unit: h$^{-1}$, hereinafter abbreviated as "LHSV") of 0.2 to 1 by passing the composition through a fixed bed hydrotreating tower using a Ni—Mo-type catalyst. The hydrotreated product is then filtered generally through a 0.1–10 $\mu$m filter to produce a hydrogenated pitch.

The hydrogenated product can be continuously supplied to vacuum distillation equipment as required to remove the condensed polycyclic (dicyclic or more) aromatic compounds and components with low boiling points.

In the hydrotreatments, the rate of desulfurization for the pitch is preferably from 40% to 60%. If the rate of desulfurization is less than 40%, the ratio of non-oriented carbon in the same mesophase content increases whereas if the rate of desulfurization exceeds 60%, the ratio of non-oriented carbon decreases, which makes it difficult to obtain a carbon fiber having a high elastic modulus and compressive strength.

The pitch hydrogenated in this manner is subjected to the first and second heat treatments to produce a mesophase pitch.

In this first heat treatment, it is preferable that the pitch be continuously supplied to a pipe-type reactor using a pump after heat treatment and be heat-treated at 430 to 500° C. for a residence time of 2 to 60 minutes either under normal pressure or under pressure.

It is necessary to advance polymerization of the hydrogenated pitch as the raw material by the heat treatment through the formation of heavier products of the pitch and to advance the reaction just before the mesophase pitch is produced so that the content of toluene-insoluble matter in the resulting heat-treated pitch is preferably more than 10% and less than 50%. Such a heat-treatment of the pitch enables the yield of the pitch to increase and allows the mesophase pitch to be produced in a short time by the second heat-treatment.

If the content of toluene-insoluble matter in the heat-treated pitch exceeds 50% or is less than 10%, the ratio of the non-oriented carbon in the same mesophase pitch is greater or smaller than the limits of the desired range. Therefore, the target pitch cannot be obtained. Also, coked components tend to be by-produced in the first heat-treatment and the yield of the mesophase pitch also decreases. Further, formation of the mesophase pitch by the second heat-treatment requires a long period of time, which makes it difficult to produce a pitch having excellent spinning characteristics.

As the method for forming the mesophase pitch by the second treatment, well-known methods may be adopted.

The second heat-treatment serves to remove low molecular components inhibiting the spinning properties in a short time from the heat-treated pitch obtained in the first heat-treatment and also to promote the formation of the mesophase pitch.

The second heat-treatment can be carried out generally at 340 to 450° C. and preferably at 370 to 420° C. either under normal pressure or under pressure by introducing an inert gas such as nitrogen gas.

The heat-treating time in this case may be optionally designed depending on the conditions such as the temperature, the amount of inert gas to be introduced, and the like though it is generally from 1 to 50 hours and preferably from 3 to 20 hours.

The amount of the inert gas to be introduced is desirably 0.02 to 3.0 $m^3$/hour per 1 kg of the pitch.

In addition, forcible agitation is effective to remove low boiling components in a short time and to increase the content of the mesophase pitch. This forcible agitation can prevent dangerous coking caused by ununiform heating or by channeling.

The pitch produced in this manner has the following characteristics: the content of toluene-insoluble matter: 60 to 100%, softening point: 260 to 320° C., the content of quinoline-insoluble matter: 10 to 45%, and the content of a mesophase: 80 to 100% Also, the ratio of non-oriented carbon of the pitch is 0.21 to 0.37 at 300° C. and 0.16 to 0.31 at 340° C. The pitch can possess the feature in that the ratio of non-oriented carbon decreases at a rate of generally 0.005 to 0.05 and preferably 0.008 to 0.02 every increment of 10° C. from 300 to 350° C.

The pitch thus obtained and satisfying the above definition of the ratio of non-oriented carbon is extended at a drawing velocity of 100 to 2,000 m/minute while extruding the pitch using a nozzle defined in the present invention from an outlet pore with a diameter D4 of 0.05 to 0.5 mm under a pressure of 1 to 200 kg/$cm^2$ at such a temperature that the melt viscosity is generally 10 to 150 Pa.s and preferably 20 to 80 Pa.s to produce a pitch fiber with a diameter of 5 to 20 $\mu$m. The number of the outlet pores formed in the dice may be 1 to 3,000 and one or more outlet pores can be formed every one introduction port.

In the spinning of the pitch fiber of the present invention, the pitch is contracted once at the nozzle inlet portion formed in the lower portion of the spinning nozzle. The pitch is then expanded after it passes through the nozzle inlet portion. The pitch is contracted again in the first approach section extending from the introduction port to the outlet pore and at the second approach section following the first approach section. The pitch is then allowed to pass through the outlet pore formed at the collecting portion of the second approach section to spin the pitch.

FIG. 1 shows the figure of a typical example of such a spinning nozzle. The carbon fiber produced by such a nozzle contains a little radial component in its surface layer. The entire section of the fiber has a vertically sectional structure with a plurality of structures showing that the fiber can maintain highly compressive strength.

The form of the nozzle is now explained with reference to FIG. 1.

In order to produce the carbon fiber with such a structure, the use of a nozzle having the following structure is of importance. Specifically, as shown in FIG. 1, the first approach section forms a slant portion spreading from the side of the outlet pore 8 to the introduction port 5 at an angle θ1 of generally 40 to 150 degrees and preferably 60 to 150 degrees. The second approach section connected to the end of the first approach section forms a slant-like portion spreading from the outlet pore 8 to the end of the introduction port 5 at an angle θ2 of 170 to 185 degrees and preferably 175 to 180 degrees.

Figure 2A:
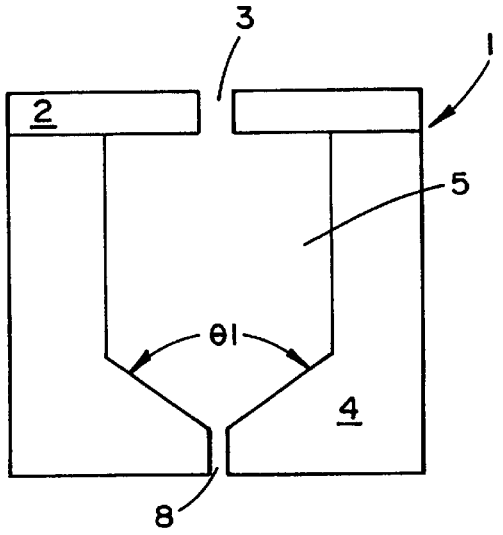
FIG. 2 is a typical view showing an example of a nozzle used in a conventional process in which FIG. 2(*a*) shows a nozzle with one approach section and FIG. 2(*b*) shows a nozzle having no approach section and an introduction port with a flat bottom.
Figure 2B:
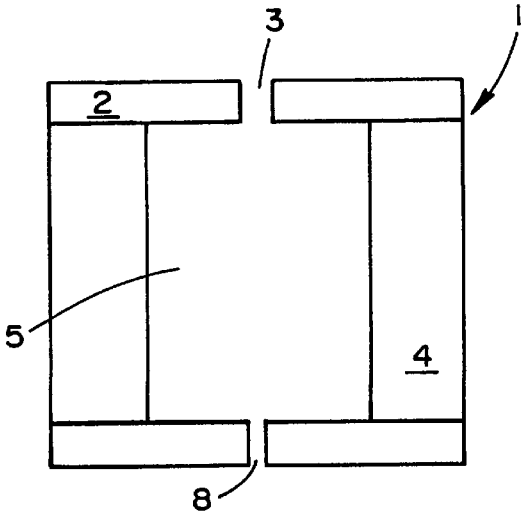

If a nozzle having a single approach section shown FIG. 2(*a*) is adopted for the purpose of forming a structure with a less resident space when the flow from the introduction port to the outlet pore is contracted, the radial structure in the surface layer of the carbon fiber will grow, which is undesirable. Also, the use of a cylindrical nozzle provided with no approach section and having a flat bottom of an introduction port shown FIG. 2(*b*) does not ensure the improvement in the compressive strength that is intended in the present invention.

When the angle of the first approach section of the spinning nozzle used in the present invention is less than 40 degrees, the first approach section is lengthy, which is undesirable. On the other hand when the angle exceeds 150 degrees, the compressive strength decrease whereby the effect to be obtained by the provision of the second approach section is not secured.

If the angle of the second approach section is less than 170 degrees, the radial structure in the surface layer of the carbon fiber will grow, so this is undesirable. The angle exceeding 185 degrees is undesirable since a spinning dice cannot withstand the spinning pressure.

In order to obtain greater compressive strength, preferably the introduction port has a form of cylinder with the axis being parallel to the direction of the flow of spinning in general, the diameter D2 of the introduction port is generally from 0.5 to 10 mm and preferably from 1.2 to 5 mm, and the residence time in the introduction port is from 1 to 400 seconds and preferably from 4 to 200 seconds.

Especially preferable is a nozzle having the structure in which the length L2 of the introduction port including the approach section is from 2 to 5 mm, the length L3 of the outlet pore is from 0.1 to 0.5 mm, and the slant angle θ2 of the second approach section is 180 degrees, specifically, perpendicular to the flow of spinning and flat.

If the length of the introduction port is less than 0.5 mm or exceeds 10 mm, the compressive strength slightly decreases. Similarly, if the residence time in the introduction port is less than one second or exceeds 400 seconds, a fiber having higher compressive strength cannot be obtained.

The contraction of the molten pitch at the inlet portion of the nozzle may be carried out using a template 2 formed with an orifice which is disposed on the spinning dice 4.

The form of the orifice greatly relates to the structure in the center of the fiber section and therefore is preferably circular or slit. The shear rate of the molten pitch is generally from 5 $s^{-1}$ to 10,000 $s^{-1}$. The shear rate less than 5 $s^{-1}$ or exceeding 10,000 $s^{-1}$ results in insufficient improvement in the compressive strength.

The plate thickness L1 of the template is generally from 0.3 to 0.5 mm and the diameter or width D1 of the orifice is generally 0.1 to 0.5 mm.

The maximum diameter D3 of the second approach section opened to the side of the introduction port is generally 0.01 to 0.8 times the diameter D2 of the introduction port and is preferably 1.5 to 30 times the diameter D4 of the outlet pore. According to this structure, the molten pitch is contracted once at the orifice, is then expanded in the introduction port, is again contracted in the first and second approach sections extending from the introduction port to the outlet pore, and is allowed to pass through the outlet pore formed in the center of the second approach section to spin the molten pitch.

Any form may be used for the outlet pore though the use of a circular outlet pore is preferable to improve the compressive strength.

The followings are explanations for a second embodiment of the present invention.

According to the second embodiment, a mesophase pitch is allowed to pass through a screen attached to an inlet portion of a template. The mesophase pitch is then allowed to pass through an orifice and thereby to be contracted once. The pitch is expanded in an introduction port with a diameter greater than that of the orifice. Finally, the pitch is allowed to pass through an outlet pore formed at a collecting portion to spin the pitch.

As raw materials used for molten spinning in the second embodiment, petroleum-type pitches, coal-type pitches, and synthetic pitches are exemplified.

Typical examples of the petroleum-type pitch include a decant oil pitch and ethylene tar pitch. Typical examples of the coal-type pitch include a coal-tar pitch and liquefied coal pitch. Typical examples of the synthetic pitch include various pitches such as a naphthalene pitch and the like.

In the present invention, among these pitches, pitches containing an optically anisotropic phase, that is, a mesophase pitch is used. Pitches containing the optically anisotropic phase in a proportion of generally 50 to 100%, preferably 80 to 100%, and more preferably 90 to 100% are used.

The spinning nozzle of the present invention is used in a process in which a molten mesophase pitch is allowed to pass through the screen attached to an inlet portion of the template, the pitch is then allowed to pass through the orifice and thereby to be contracted once, the pitch is expanded in the introduction port with a diameter greater than that of the orifice, and finally, the pitch is allowed to pass through the outlet pore, to spin the pitch. In a preferred embodiment, the molten mesophase pitch is allowed to pass through a screen attached to the inlet portion of the template. The mesophase pitch is then allowed to pass through the orifice and thereby to be contracted once. The pitch is expanded in the introduction port with a diameter greater than that of the orifice. Then the pitch is again contracted in a first approach section extending from the introduction port to the outlet pore and in a second approach section following the first approach section. Finally, the pitch is allowed to pass through an outlet pore formed in the center or at a collecting portion of the second approach section to spin the pitch.

Figure 3:
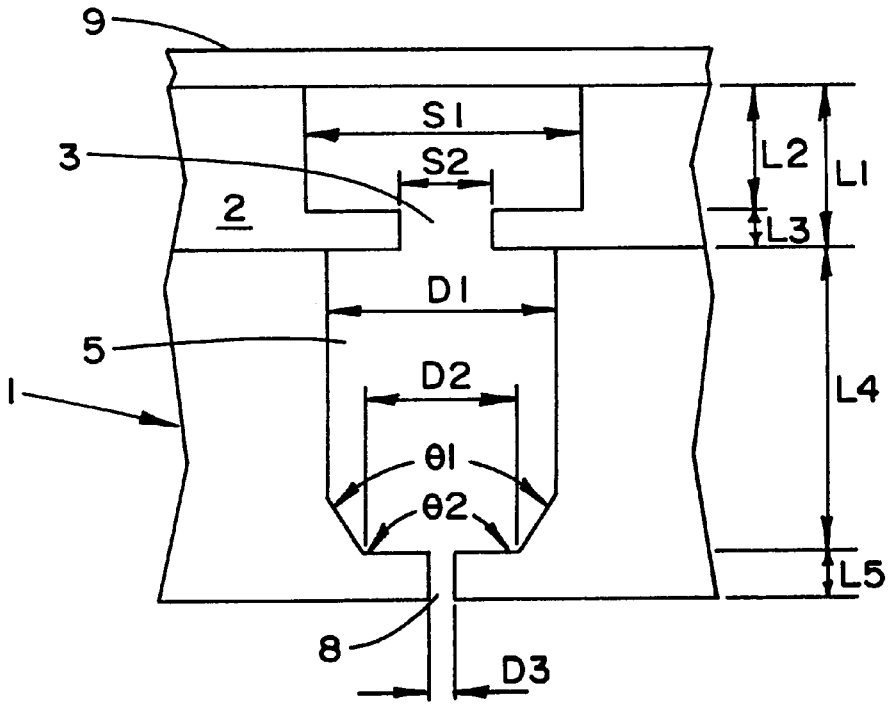

The configuration of such a spinning nozzle is shown in FIG. 3. A carbon fiber produced by carbonizing the pitch fiber obtained from such a nozzle is decreased in the content of a radial component in the surface layer of the fiber. The entire section of the fiber has a transversally sectional structure with a plurality of structures formed of a microtexture whereby the carbon fiber can maintain highly compressive strength.

The reason why the compressive strength is improved by the present invention is considered as follows:

The screen attached to the inlet portion of the template serves to refine a texture forming the pitch by shearing force created when the pitch passes through the screen. On the other hand, the orifice serves to control the fluid form of the pitch. The pitch is allowed to pass through the orifice and thereby to be contracted once and is then expanded in the introduction port with a diameter larger than that of the orifice whereby the texture forming the pitch is oriented onion-wise.

Specifically, the texture forming the pitch is refined using the screen and is then allowed to pass through the orifice whereby the refined texture is oriented onion-wise. The pitch is then allowed to pass through the outlet pore to spin the fiber whereby a sectional structure involving the onion structure which is most suitable for improving the compressive strength is formed, so we consider.

In the preferred embodiment, the pitch is again contracted in the first approach section extending from the introduction port to the outlet pore in the nozzle and in the second approach section following the first approach section and the pitch is then allowed to pass through an outlet pore formed in the center or at a collecting portion of the second approach section to spin the pitch, whereby the ratio of the onion structure in the transversally sectional structure of the carbon fiber is controlled, resulting in the production of a carbon fiber having the most appropriate characteristics.

If the template provided with the orifice and the screen are inversely positioned, that is, if the pitch is allowed to pass through the screen after it has been delivered from the orifice, the effect of the orifice decreases and the transversally sectional structure of the carbon fiber contains much radial component, which makes it difficult to produce a carbon fiber having high compressive strength.

The form of the nozzle is now explained with reference to FIG. 3.

The fineness of the screen arranged at the inlet portion of the template is generally from 100 to 2,500 mesh and most preferably from 500 to 2,000 mesh to produce the above structure of the carbon fiber. The thickness of the screen (9) is generally from 0.01 to 5 mm and most preferably 0.1 to 3 mm. The area (S1) of the screen through which the pitch passes is generally 1 $mm^2$ or more and most preferably 4 $mm^2$ or more per nozzle. The length (L2) between the screen and the inlet of the orifice is generally from 0.2 to 9 mm and most preferably from 0.5 to 5 mm.

A template formed with an orifice may be used to contract the pitch once after passing the pitch through the screen. The form of the orifice greatly relates to the structure in the center of the fiber transversal section and therefore is preferably circular or slit. The plate thickness (L1) of the template is preferably from 0.5 to 10 mm and the area (S2) of the orifice is generally from 0.008 $mm^2$ to 1 $mm^2$ and most preferably from 0.017 $mm^2$ to 0.5 $mm^2$. The length (L3) of the orifice is preferably from 0.3 to 1 mm.

The first approach section extending from the introduction port to the outlet pore forms an angle (θ1) of generally 40 to 150 degrees and most preferably from 60 to 150 degrees. The second approach section connected to the end of the first approach section and opened to the introduction port forms an angle (θ2) of generally 170 to 185 degrees and most preferably from 175 to 180 degrees. Also, the maximum diameter (D2) of the second approach section is generally 0.01 to 0.8 times the diameter (D1) of the introduction port and is preferably 1.5 to 30 times the diameter (D3) of the outlet pore. The diameter (D3) is preferably from 0.05 to 0.5 mm.

The introduction port has a form of cylinder with the axis being parallel to the direction of the flow of spinning in general, the diameter (D1) of the introduction port is generally from 0.5 to 10 mm and most preferably from 1.2 to 5 mm, and the residence time in the introduction port is from 1 to 400 seconds and most preferably from 4 to 200 seconds.

Especially preferable is a nozzle having the structure in which the length (L4) of the introduction port including the approach section is generally from 2 to 10 mm and the length (L5) of the outlet pore is generally from 0.1 to 0.5 mm. Any form may be used for the outlet pore though the use of a circular outlet pore is preferable to improve the compressive strength.

In the present invention, the pitch for spinning is extended at a drawing velocity of 100 to 2,000 m/minute while extruding the pitch using the above spinning nozzle from an outlet pore at a spinning pressure of 1 to 200 kg/cm$^2$ at such a temperature that the melt viscosity is generally 8 to 300 Pa.s and preferably 20 to 200 Pa.s to produce a pitch fiber with a fiber diameter of 5 to 20 $\mu$m.

The number of the outlet pores formed in the dice may be either singular or plural though preferably 1 to 3,000.

Next, a process for treating the pitch fiber produced in the first and second embodiments are now explained.

The produced pitch fiber is maintained at generally 100 to 360° C. and preferably 130 to 320° C. under an acidic gas atmosphere for generally 10 minutes to 10 hours and preferably 1 to 6 hours to carry out infusible treatment.

As the acidic gas, oxygen, air, or a mixture of each of these gases and nitrogen dioxide, chlorine, or the like may be used.

The fiber which has been subjected to infusible treatment is calcinated, specifically, carbonized or graphitized, at generally 1,000 to 3,000° C. under an atmosphere of gas, such as nitrogen, argon, or the like, to produce a pitch-type carbon fiber improved in the compressive strength.

Incidentally, the fiber may be primarily carbonized at 300 to 800° C. under an inert gas atmosphere prior to the calcination.

The carbon fiber thus obtained has the following characteristics: the elastic modulus in tension is from 500 to 1,000 GPa and the compressive strength is from 500 to 1,100 MPa.

Furthermore, the carbon fiber can exhibit excellent oxidation resistance even if it is exposed to an oxidative gas at over 500° C. or more atmosphere.

In addition, the rate of desulfurization of the pitch was measured using an automatic combustion tube-type sulfur testing apparatus according JIS K2541 (Testing Method for sulfur in Crude oil and petroleum product) 4.4.

In the present invention, the mesophase pitch means a pitch exhibiting optical anisotropy which can be viewed when the section of the pitch is observed using a polarization microscope. The content is indicated by the fractional ratio of an optically anisotropic area.

The ratio of non-oriented carbon can be measured using a b 13C-NMR (MSL-300 type, manufactured by Bruker) according to a conventionally known method (Nishizawa, 14th Carbon Material Association Annual Meeting, 1A 15 (1987)).

About 0.5 g of a sample was placed in a high-temperature NMR sample tube with an inner diameter of 9 mm and the sample tube is placed in a high-temperature probe head. The sample was heated at a rate of 5° C./minute in a nitrogen stream to measure at the prescribed temperatures (300° C., 340 ° C).

The spectrum can be roughly divided into three groups. A first group is a signal of aliphatic carbon which is indicated in a spectrum range of 10 to 40 ppm. The remainder two groups are signals of aromatic carbon which are indicated at 130 ppm and 180 ppm as the centers of the spectrum. The aromatic signal at 130 ppm indicates that of a non-oriented aromatic carbon molecule whereas the aromatic signal at 180 ppm indicates that of an oriented aromatic carbon molecule. The ratio of non-oriented carbon is calculated by the following formula:

The rate of non-oriented carbon=Integrated intensity at 130 ppm/(Integrated intensity at 180 ppm+Integrated intensity at 130 ppm)

The tension characteristics of the carbon fiber were measured according to a Strand test method defined in JIS-R-7601.

The compressive characteristics of the carbon fiber were measured according to a 0° Compressive strength test method defined in ASTM-D3410.

For the measurement of quinoline-insoluble matter in the present invention, a centrifugal method defined in JIS K2425-1983 was adopted. In this method, 1 g of a sample is dissolved in 30 ml of a hot quinoline and the mixture is heated at 80° C. for 30 minutes. Next, the mixture is centrifuged at 1,400 G or more and then centrifuged using acetone to measure the content of insoluble matter.

For the measurement of toluene-insoluble matter in the present invention, a method described in JIS K2425-1983 was adopted. In this method, 10 g of a sample is dissolved in 50 ml of a hot toluene, the mixture is heat-boiled under reflux, and the residue is filtered while aspirating, followed by washing with toluene and acetone to measure the quantity of the residue.

The shearing rate $\gamma$ was measured according to the following formula:

$$\text{The shearing rate}\gamma=32Q/(\pi DI^3)$$

wherein Q is a discharge amount (m$^3$/s) of a pitch and DI is a diameter (m) of an orifice.

The present invention enables production of carbon fibers having the onion or random structure inside the fibers and the random structure including not much radial component in the surface layer of the fibers. The produced pitch-type carbon fibers are featured not in high tensile strength and elastic modulus in tension but also in high compressive strength.

EXAMPLES

The present invention will be explained in more detail by way of examples, which are not intended to be limiting of the present invention. Among these examples, Examples 1 to 4 relate to the first embodiment and Examples 5 to 10 relate to the second embodiment.

Example 1

A mixture prepared by adding 50 parts by weight of anthracene oil to 100 parts by weight of a coal tar pitch with a softening point of 60° C. was continuously hydrotreated in the condition of a temperature of 380° C., a hydrogen pressure of 150 kg/cm$^2$, and a LHSV of 0.25 by passing the mixture at a rate of 5 L/minute through a fixed bed hydrotreating tower using a Ni—Mo-type catalyst. Filtering the hydrotreated product through a 3 $\mu$m filter, it was continuously supplied to a distillation tower operated at 280° C. under a pressure of 4 to 5 torr to distill off the solvent and low-boiling point components contained in the pitch to produce a hydrogenated pitch at a rate of desulfurization of 55%. The hydrogenated pitch was melted under heat at 250° C. and was then continuously supplied to a pipe-type reactor, in which it was treated under heat at 450° C. for 45 minutes under normal pressure to prepare a pitch A. The softening point and the content of toluene-insoluble matter of the pitch A were 150° C. and 15% respectively.

30 kg of the pitch A was subsequently supplied to a reactor. The pitch was stirred while blowing nitrogen at a rate of 3.6 m$^3$/hour and was treated under heat at 400° C. for 10 hours to obtain a pitch B having the following characteristics: the softening point: 310° C., the content of quinoline-insoluble matter: 38%, the content of toluene-insoluble matter: 72%, the content of a mesophase: 94%, and the rate of non-oriented carbon: 0.25 at 300° C. and 0.20 at 340° C.

Next, spinning of the pitch B was performed using a nozzle shown in FIG. 1 and having the following conditions: the diameter D4 of the outlet pore: 0.14 mm, the length L3 of the outlet pore: 0.28 mm, the number of outlet pores: 1,000, the diameter D3 of the second approach section in the side opened to the introduction port: 0.8 mm, the diameter D2 of the introduction port: 2 mm, the length L2 of the introduction port: 5 mm, the angle θ1 of the first approach section spreading to the introduction port: 90 degrees, the angle θ2 of the second approach section spreading to the introduction port: 180 degrees, and the second approach section was formed with the outlet pore in the center thereof. In the nozzle, the orifice was arranged which had the following conditions: the diameter D1 of the orifice: 0.3 mm, the plate thickness L1 of the template is 0.5 mm, and the form of the pore: circular, the orifice being used to pass each stream of the pitch. The pitch was spun in the condition in which the melt viscosity of the mesophase pitch was 60 Pa.s, the drawing velocity was 300 m/minutes, the residence time in the introduction port was 30 seconds, and the shearing rate at the orifice was 1,850 $s^{-1}$ to produce a pitch fiber with a size of 13 μm. The pitch fiber was sampled in a can.

The temperature of the pitch fiber stored in the can was raised at a rate of 2° C./minute in air containing 3% nitrogen dioxide by volume and the pitch fiber was maintained at 300° C. for 30 minutes to obtain an infusible fiber.

The temperature of the infusible fiber stored in the can was raised to 400° C. at a rate of 10° C./minute under a nitrogen atmosphere and the infusible fiber was maintained at this temperature for 30 minutes to perform primary carbonization. The carbonized fiber was graphitized at 2,500° C. to manufacture a carbon fiber.

The produced carbon fiber had an elastic modulus in tension of 600 GPa, a tensile strength of 3.8 GPa, and a compressive strength of 520 MPa.

The section in the direction of the transversal cross-section of the carbon fiber which was observed using a scanning electron microscope showed that the center portion with about 3 μm thickness of the fiber formed the onion structure and the surface layer with about 1.5 μm thickness formed the radial structure.

Example 2

A mixture prepared by adding 50 parts by weight of anthracene oil to 100 parts by weight of a coal tar pitch with a softening point of 60° C. was continuously hydrotreated in the condition of a temperature of 370° C., a hydrogen pressure of 150 kg/$cm^2$, and a LHSV of 0.25 by passing the mixture at a rate of 5 L/minute through a fixed bed hydrotreating tower using a Ni—Mo-type catalyst. Filtering the hydrotreated product through a 3 μm filter, it was continuously supplied to a distillation tower operated at 280° C. under a pressure of 4 to 5 torr to distill off the solvent and low-boiling point components contained in the pitch to produce a hydrogenated pitch at a rate of desulfurization of 45%. The hydrogenated pitch was melted under heat at 250° C. and was then continuously supplied to a pipe-type reactor, in which it was treated under heat at 450° C. for 45 minutes under normal pressure to prepare a pitch C. The softening point and the content of toluene-insoluble matter of the pitch C were 155° C. and 18% respectively.

The 30 kg of the pitch C was subsequently supplied to a reactor. The pitch was stirred while blowing nitrogen at a rate of 3.6 $m^3$/hour and was treated under heat at 400° C. for 9.5 hours to obtain a pitch D having the following characteristics: the softening point: 310° C., the content of quinoline-insoluble matter: 37%, the content of toluene-insoluble matter: 68%, the content of a mesophase: 92%, and the rate of non-oriented carbon: 0.27 at 300° C. and 0.22 at 340° C.

Next, spinning of the pitch D was performed using the same nozzle and in the same condition as in Example 1 to prepare a pitch fiber with a size of 13 μm. The pitch fiber was sampled in a can.

The pitch fiber stored in the can was, as it was, subjected to infusible treatment, primary carbonization, and graphitization in the same manner as in Example 1 to produce a carbon fiber.

The produced carbon fiber had an elastic modulus in tension of 580 GPa, a tensile strength of 3.8 GPa, and a compressive strength of 560 MPa.

Example 3

The 30 kg of the pitch C used in Example 2 was supplied to a reactor. The pitch was stirred while blowing nitrogen at a rate of 3.6 $m^3$/hour and was treated under heat at 390° C. for 13 hours to obtain a pitch E having the following characteristics: the softening point: 306° C., the content of quinoline-insoluble matter: 34%, the content of toluene-insoluble matter: 68%, the content of a mesophase: 88%, and the rate of non-oriented carbon: 0.33 at 300° C. and 0.28 at 340° C.

Next, spinning of the pitch E was performed using the same nozzle and in the same condition as in Example 1 to prepare a pitch fiber with a size of 13 μm. The pitch fiber was sampled in a can.

The pitch fiber stored in the can was, as it was, subjected to infusible treatment, primary carbonization, and graphitization in the same manner as in Example 1 to produce a carbon fiber.

The produced carbon fiber had an elastic modulus in tension of 580 GPa, a tensile strength of 3.7 GPa, and a compressive strength of 590 MPa.

Example 4

The 30 kg of the pitch C used in Example 2 was supplied to a reactor. The pitch was stirred while blowing nitrogen at a rate of 3.6 $m^3$/hour and was treated under heat at 380° C. for 15 hours to obtain a pitch F having the following characteristics: the softening point: 302° C., the content of quinoline-insoluble matter: 32%, the content of toluene-insoluble matter: 62%, the content of a mesophase: 82%, and the rate of non-oriented carbon: 0.35 at 300° C. and 0.30 at 340° C.

Next, spinning of the pitch F was performed using the same nozzle and in the same condition as in Example 1 to prepare a pitch fiber with a size of 13 μm. The pitch fiber was sampled in a can.

The pitch fiber stored in the can was, as it was, subjected to infusible treatment and primary carbonization in the same manner as in Example 1.

Next, the carbonized fiber was graphitized at 2,650° C. to produce a carbon fiber.

The produced carbon fiber had an elastic modulus in tension of 680 GPa, a tensile strength of 3.9 GPa, and a compressive strength of 510 MPa.

Comparative Example 1

A mixture prepared by adding 60 parts by weight of anthracene oil to 100 parts by weight of a coal tar pitch with a softening point of 60° C. was continuously hydrotreated in the condition of a temperature of 380° C., a hydrogen pressure of 150 kg/cm$^2$, and a LHSV of 0.2 by passing the mixture at a rate of 5 L/minute through a fixed bed hydrotreating tower using a Ni—Mo-type catalyst. Filtering the hydrotreated product through a 3 μm filter, it was continuously supplied to a distillation tower operated at 280° C. under a pressure of 4 to 5 torr to distill off the solvent and low-boiling point components contained in the pitch to produce a hydrogenated pitch at a rate of desulfurization of 60%.

The hydrogenated pitch was melted under heat at 250° C. and was then continuously supplied to a pipe-type reactor, in which it was treated under heat at 450° C. for 45 minutes under normal pressure to prepare a pitch G. The softening point and the content of toluene-insoluble matter of the pitch G were 140° C. and 13% respectively.

The 30 kg of the pitch G was subsequently supplied to a reactor. The pitch was stirred while blowing nitrogen at a rate of 3.6 m $^3$/hour and was treated under heat at 400° C. for 10 hours to obtain a pitch H having the following characteristics: the softening point: 308° C., the content of quinoline-insoluble matter: 37%, the content of toluene-insoluble matter: 65%, the content of a mesophase: 96%, and the rate of non-oriented carbon: 0.14 at 340° C.

Next, spinning of the pitch H was performed using the same nozzle and in the same condition as in Example 1 to prepare a pitch fiber with a size of 13 μm. The pitch fiber was sampled in a can.

The pitch fiber stored in the can was, as it was, subjected to infusible treatment, primary carbonization, and graphitization in the same manner as in Example 1 to produce a carbon fiber.

The produced carbon fiber had an elastic modulus in tension of 630 GPa, a tensile strength of 3.8 GPa, and a compressive strength of 420 MPa.

The section in the direction of the transversal cross-section of the carbon fiber which was observed using a scanning electron microscope showed that the center portion with about 4 μm thickness of the fiber formed the onion structure and the surface layer with about 1.5 μm thickness formed the radial structure.

Comparative Example 2

A mixture prepared by adding 50 parts by weight of anthracene oil to 100 parts by weight of a coal tar pitch with a softening point of 60° C. was continuously hydrotreated in the condition of a temperature of 370° C., a hydrogen pressure of 150 kg/cm$^2$, and a LHSV of 0.4 by passing the mixture at a rate of 8 l/minute through a fixed bed hydrotreating tower using a Ni—Mo-type catalyst. Filtering the hydrotreated product through a 3 μm filter, it was continuously supplied to a distillation tower operated at 280° C. under a pressure of 4 to 5 torr to distill off the solvent and low-boiling point components contained in the pitch to produce a hydrogenated pitch at a rate of desulfurization of 30%. The hydrogenated pitch was melted under heat at 250° C. and was then continuously supplied to a pipe-type reactor, in which it was treated under heat at 450° C. for 45 minutes under normal pressure to prepare a pitch I. The softening point and the content of toluene-insoluble matter of the pitch I were 165° C. and 23% respectively.

The 30 kg of the pitch I was subsequently supplied to a reactor. The pitch was stirred while blowing nitrogen at a rate of 3.6 m$^3$/hour and was treated under heat at 400° C. for 10 hours to obtain a pitch J having the following characteristics: the softening point: 308° C., the content of quinoline-insoluble matter: 41%, the content of toluene-insoluble matter: 80%, the content of a mesophase: 88%, and the rate of non-oriented carbon: 0.38 at 340° C. Next, spinning of the pitch J was performed using the same nozzle and in the same condition as in Example 1 to prepare a pitch fiber with a size of 13 μm. The pitch fiber was sampled in a can.

The pitch fiber stored in the can was, as it was, subjected to infusible treatment, primary carbonization, and graphitization in the same manner as in Example 1 to produce a carbon fiber.

The produced carbon fiber had an elastic modulus in tension of 500 GPa, a tensile strength of 3.5 GPa, and a compressive strength of 420 MPa.

Comparative Example 3

The 30 kg of the pitch I prepared in CoMParative Example 2 was supplied to a reactor. The pitch was stirred while blowing nitrogen at a rate of 3.6 m$^3$/hour and was treated under heat at 400° C. for 9 hours to obtain a pitch K having the following characteristics: the softening point: 308° C., the content of quinoline-insoluble matter: 21%, the content of toluene-insoluble matter: 75%, the content of a mesophase: 82%, and the rate of non-oriented carbon: 0.41 at 340° C.

Next, spinning of the pitch K was performed using the same nozzle and in the same condition as in Example 1 to prepare a pitch fiber with a size of 13 μm. The pitch fiber was sampled in a can.

The pitch fiber stored in the can was, as it was, subjected to infusible treatment, primary carbonization, and graphitization in the same manner as in Example 1 to produce a carbon fiber.

The produced carbon fiber had an elastic modulus in tension of 460 GPa, a tensile strength of 3.4 GPa, and a compressive strength of 460 MPa.

Comparative Example 4

A pitch fiber with a size of 13 μm was prepared by spinning the pitch B prepared in Example 1 in the same spinning condition as in Example 1 using the same nozzle as in Example 1 such as FIG. 2(*a*), except that the nozzle was provided with only one approach section and the angle θ1 of the approach section spreading to the introduction port was 60 degrees. The pitch fiber was sampled in a can.

The pitch fiber stored in the can was, as it was, subjected to infusible treatment, primary carbonization, and graphitization in the same manner as in Example 1 to produce a carbon fiber.

The produced carbon fiber had an elastic modulus in tension of 620 GPa, a tensile strength of 3.2 GPa, and a compressive strength of 400 MPa.

The section in the direction of the transversal cross-section of the carbon fiber which was observed using a scanning electron microscope showed that the center portion with about 3 μm thickness of the fiber formed the onion structure and the surface layer with about 3 μm thickness formed the radial structure.

Example 5

In this Example, spinning was performed using a coal-type spinning pitch and a spinning nozzle shown in FIG. 3 and having the following structure:

The screen attached to the inlet portion of the template had a fineness of 1,500 mesh and the area (S1) of the screen was 5 mm$^2$ per nozzle.

A template formed with an orifice shown in FIG. 7-*a* was used in each stream of the pitch which extends to the introduction port. The area (S2) of the orifice was 0.03 $mm^2$. The plate thickness (L1) of the template was 2.5 mm and the length (L3) of the orifice was 0.5 mm.

The diameter (D1) of the introduction port was 1.5 mm, the length (L4) of the introduction port was 5 mm, the angle (θ1) of the first approach section in the side opened to the introduction port was 120 degrees, the angle (θ2) of the second approach section in the side opened to the introduction port was 180 degrees, and the diameter (D2) of the second approach section in the side opened to the introduction port was 0.8 mm.

The outlet pore was formed in the center of the second approach section. The diameter (D3) and length (L5) of the outlet pore were 0.12 mm and 0.24 mm respectively. The number of outlet pores were 1,000.

The pitch fiber which was spun in the condition of a spinning viscosity of 60 Pa.s and a drawing velocity of 300 m/minute was sampled in a can. The resulting pitch fiber had a diameter of 12.5 μm.

The temperature of the pitch fiber stored in the can was raised to 300° C. at a rate of 2° C./minute in air containing 2% nitrogen dioxide by volume and the pitch fiber was maintained at this temperature for 60 minutes to obtain an infusible fiber.

The temperature of the infusible fiber was raised to 700° C. at a rate of 10° C./minute under a nitrogen atmosphere and the infusible fiber was maintained at this temperature for 30 minutes to perform primary carbonization.

The carbonized fiber was graphitized at 2,300° C. to manufacture a carbon fiber.

The produced carbon fiber had a fiber diameter of about 10 μm, an elastic modulus in tension of 573 GPa, a tensile strength of 3.9 GPa, and a compressive strength of 610 MPa.

The section in the direction of the transversal cross-section of the carbon fiber which was observed using a scanning electron microscope showed that it had a transversally sectional structure with a plurality of structures formed of a micro-texture, the center portion with about 7 μm diameter of the fiber formed the onion structure and the surface layer with about 1.5 μm thickness formed the radial structure.

Example 6

Spinning was performed using a petroleum-type spinning pitch and the same nozzle as in Example 5 in the same spinning condition as in Example 5 to produce a pitch fiber. The resulting pitch fiber was sampled in a can. The diameter of the pitch fiber was 12.5 μm.

The pitch fiber stored in the can was, as it was, subjected to infusible treatment, primary carbonization, and graphitization in the same manner as in Example 5, except that the temperature in the infusible treatment was raised to 250° C., to produce a carbon fiber.

The produced carbon fiber had an elastic modulus in tension of 621 GPa, a tensile strength of 4.0 GPa, and a compressive strength of 582 MPa.

Example 7

Spinning was performed using a synthetic-type spinning pitch and the same nozzle as in Example 5 in the same spinning condition as in Example 5 to produce a pitch fiber. The resulting pitch fiber was sampled in a can. The diameter of the pitch fiber was 12.5 μm.

The pitch fiber stored in the can was, as it was, subjected to infusible treatment, primary carbonization, and graphitization in the same manner as in Example 6 to produce a carbon fiber.

The produced carbon fiber had an elastic modulus in tension of 639 GPa, a tensile strength of 3.9 GPa, and a compressive strength of 561 MPa.

Example 8

Spinning was performed using the same coal-type spinning pitch and the same nozzle as in Example 5 in the same spinning condition as in Example 5, except that a template formed with an orifice shown in FIG. 7-*b* was used in each stream of the pitch extending to the introduction port, to produce a pitch fiber. The resulting pitch fiber was sampled in a can. The diameter of the pitch fiber was 12.5 μm. It is noted that the area (S2) was 0.23 $mm^2$. The pitch fiber stored in the can was, as it was, subjected to infusible treatment, primary carbonization, and graphitization in the same manner as in Example 5 to produce a carbon fiber.

The produced carbon fiber had an elastic modulus in tension of 591 GPa, a tensile strength of 4.1 GPa, and a compressive strength of 598 MPa.

Example 9

Spinning was performed using the same synthetic-type spinning pitch as in Example 7 and the same nozzle as in Example 8 in the same spinning condition as in Example 8 to produce a pitch fiber. The resulting pitch fiber was sampled in a can. The diameter of the pitch fiber was 12.5 μm.

The pitch fiber stored in the can was, as it was, subjected to infusible treatment, primary carbonization, and graphitization in the same manner as in Example 6 to produce a carbon fiber.

The produced carbon fiber had an elastic modulus in tension of 648 GPa, a tensile strength of 4.1 GPa, and a compressive strength of 576 MPa.

Example 10

Figure 4:
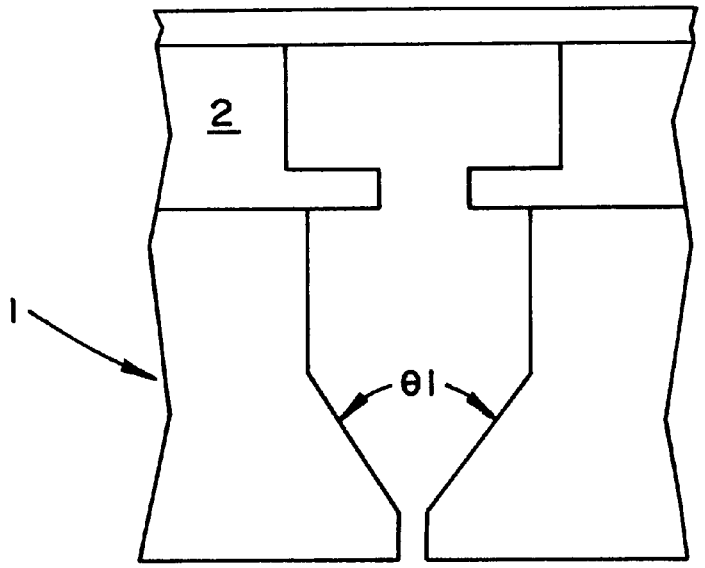

Spinning was performed using the same coal-type spinning pitch and the same nozzle as in Example 5 in the same spinning condition as in Example 5 except that the angle (θ1) of the first approach section was 60 degrees and the second approach section was not formed as shown in FIG. 4, to produce a pitch fiber. The resulting pitch fiber was sampled in a can. The diameter of the pitch fiber was 12.5 μm.

The pitch fiber stored in the can was, as it was, subjected to infusible treatment, primary carbonization, and graphitization in the same manner as in Example 5 to produce a carbon fiber.

The produced carbon fiber had a fiber diameter of 10 μm, an elastic modulus in tension of 570 GPa, a tensile strength of 3.9 GPa, and a compressive strength of 559 MPa.

The section in the direction of the transversal cross-section of the carbon fiber which was observed using a scanning electron microscope showed that the texture was fine, the center portion with about 5 μm diameter of the fiber formed the onion structure and the surface layer with about 2.5 μm thickness formed the radial structure.

Comparative Example 5

Figure 5:
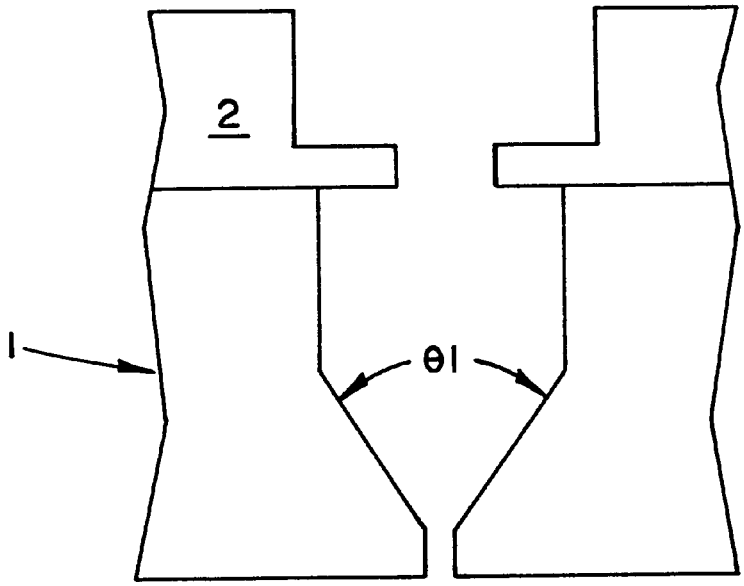

Spinning was performed using the same coal-type spinning pitch as in Example 5 and the same nozzle as in Example 10 in the same spinning condition as in Example 10, except that the screen disposed at the inlet portion of the template was omitted as shown in FIG. 5, to produce a pitch fiber. The resulting pitch fiber was sampled in a can. The diameter of the pitch fiber was 12.5 μm.

The pitch fiber stored in the can was, as it was, subjected to infusible treatment, primary carbonization, and graphitization in the same manner as in Example 5 to produce a carbon fiber.

The produced carbon fiber had an elastic modulus in tension of 616 GPa, a tensile strength of 3.7 GPa, and a compressive strength of 457 MPa.

The section in the direction of the transversal cross-section of the carbon fiber which was observed using a scanning electron microscope showed that the texture was rough, the center portion with about 5 μm thickness of the fiber formed the onion structure and the surface layer with about 2.5 μm thickness formed the radial structure.

Comparative Example 6

Figure 6:
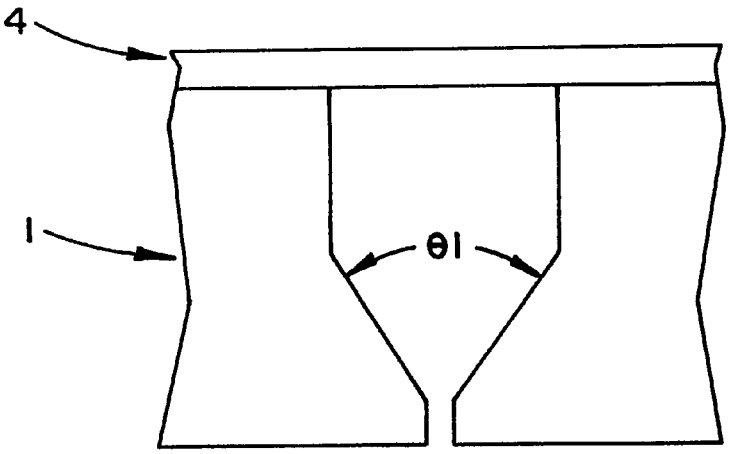
FIG. 6 is a typical view of another example of a conventional nozzle provided only with a screen.
Figure 7A:
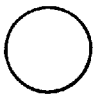
FIG. 7 is a typically sectional view showing an example of an orifice of a nozzle according to the present invention.
Figure 7B:
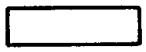
Figure 7C:
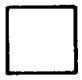
Figure 7D:
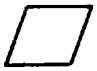
Figure 7E:
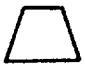
Figure 7F:
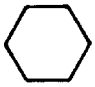
Figure 7G:
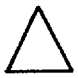
Figure 7H:
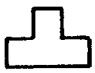
Figure 7I:
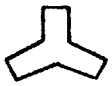
Figure 7J:
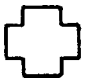
Figure 7K:
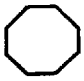
Figure 7L:
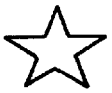
Figure 7M:
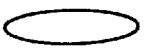
Figure 7N:
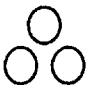

Spinning was performed using the same coal-type spinning pitch as in Example 5 and the same nozzle as in Example 10 in the same spinning condition as in Example 10, except that the template formed with the orifice was dismounted as shown in FIG. 6, to produce a pitch fiber. The resulting pitch fiber was sampled in a can. The diameter of the pitch fiber was 12.5 μm.

The pitch fiber stored in the can was, as it was, subjected to infusible treatment, primary carbonization, and graphitization in the same manner as in Example 5 to produce a carbon fiber.

The produced carbon fiber had an elastic modulus in tension of 520 GPa, a tensile strength of 3.5 GPa, and a compressive strength of 487 MPa.

The section in the direction of the transversal cross-section of the carbon fiber which was observed using a scanning electron microscope showed that the entire section was the radial structure and there was several percentages of thread breakage.

Comparative Example 7

Spinning was performed using the same synthetic-type spinning pitch as in Example 7 and the same nozzle as in Example 5 in the same spinning condition as in Example 5, except that the screen disposed at the inlet portion of the template was omitted as shown in FIG. 3, to produce a pitch fiber. The resulting pitch fiber was sampled in a can. The diameter of the pitch fiber was 12.5 μm.

The pitch fiber stored in the can was, as it was, subjected to infusible treatment, primary carbonization, and graphitization in the same manner as in Example 6 to produce a carbon fiber.

The produced carbon fiber had an elastic modulus in tension of 589 GPa, a tensile strength of 3.8 GPa, and a compressive strength of 468 MPa.

What is claimed is:

1. A process for manufacturing a pitch-type carbon fiber by melt-spinning a mesophase pitch before infusible and calcinating treatments, the ratio of non-oriented carbon of the mesophase pitch being in the range of 0.21 to 0.37 at 300° C. and in a range from 0.16 to 0.31 at 340° C., the process comprising:

(a) melting a mesophase pitch;

(b) contacting said molten pitch once at an outlet portion of a nozzle;

(c) expanding said pitch in an introduction port having a diameter greater than that of said outlet portion;

(d) contracting said pitch again at a first approach section in which said nozzle has a shape spreading at an angle of 40 to 150 degrees from an outlet pore to said introduction port and at a second approach section in which said nozzle has a shape spreading at an angle of 170 to 185 degrees toward said introduction port positioned between said first approach section and said outlet pore; and (e) passing said pitch through said outlet pore disposed at a collection portion of said second approach section to spin said pitch and form a fiber.

2. A process in accordance with claim 1 wherein said mesophase pitch is prepared by hydrolyzing a heavy bituminous material; heat treating said hydrolyzed heavy bituminous material; and heat treating, for a second time, said heat treated hydrolyzed heavy bituminous material.

3. A process in accordance with claim 1 wherein step (b) is carried out by means of a template.

4. A process in accordance with claim 3 including the step of passing said molten pitch through a screen attached to an inlet portion of said template, said step occurring between steps (a) and (b).

5. A process in accordance with claim 4 wherein said screen has a fineness of 100 to 2,500 mesh.

* * * * *

UNITED STATES PATENT AND TRADEMARK OFFICE

CERTIFICATE OF CORRECTION

PATENT NO. : 5,968,435

DATED : October 19, 1999

INVENTOR(S) : Osamu Kato, et al.

It is certified that error appears in the above-identified patent and that said Letters Patent is hereby corrected as shown below:

Column 2, line 59: "treatments,," should read --treatments,--

Column 9, line 44: "a-b 13C" should read --a 13--

Signed and Sealed this

Fifth Day of September, 2000

*Attest:*

*Attesting Officer*

Q. TODD DICKINSON

*Director of Patents and Trademarks*